US005401090A

United States Patent [19]

Fay

[11] Patent Number: 5,401,090

[45] Date of Patent: Mar. 28, 1995

[54] MECHANICAL AUTOMATIC AISLE LOCK

[75] Inventor: Daniel K. Fay, McFarland, Wis.

[73] Assignee: Spacesaver Corporation, Fort Atkinson, Wis.

[21] Appl. No.: 972,708

[22] Filed: Nov. 6, 1992

[51] Int. Cl.[6] ..... A47B 53/00

[52] U.S. Cl. ..... 312/201; 312/198

[58] Field of Search ..... 312/198–201; 104/147 R, 178, 288, 299; 214/16.1 CC, 16 B

[56] References Cited

U.S. PATENT DOCUMENTS

| | | | |
|---|---|---|---|
| 604,982 | 5/1898 | Habermaas | 292/141 X |
| 872,247 | 11/1907 | Moss . | |
| 1,200,693 | 10/1916 | Barton et al. . | |
| 4,017,131 | 4/1977 | Camenisch | 312/201 X |
| 4,033,649 | 7/1977 | Naito et al. | 312/201 |
| 4,138,173 | 2/1979 | Taniwaki | 312/198 |
| 4,307,922 | 12/1981 | Rhodes et al. | 312/201 X |
| 4,437,711 | 3/1984 | Dahnert | 312/201 |
| 4,523,794 | 6/1985 | Peterman | 312/201 |
| 4,607,896 | 8/1986 | Peterman | 312/201 |
| 4,708,411 | 11/1987 | Peterman | 312/201 |
| 4,733,923 | 3/1988 | Dahnert | 312/201 |
| 4,743,078 | 5/1988 | Dahnert | 312/201 |
| 4,745,516 | 5/1988 | Griffen | 312/201 X |
| 4,759,592 | 7/1988 | Dahnert | 312/201 |
| 4,783,618 | 11/1988 | Artrip | 312/201 X |
| 5,005,923 | 4/1991 | Dahnert | 312/201 |
| 5,160,189 | 11/1992 | Johnston et al. | 312/201 |
| 5,160,190 | 11/1992 | Farrell et al. | 312/201 |

FOREIGN PATENT DOCUMENTS 81538 11/1918 Germany .

*Primary Examiner*—Stephen C. Pellegrino
*Assistant Examiner*—Nancy Molcare
*Attorney, Agent, or Firm*—Ryan, Kees & Hohenfeldt

[57] ABSTRACT

A mechanism that automatically locks a movable storage unit against closure of an aisle between the unit and a blocking object such as a facing movable or stationary storage unit or wall, while permitting continued opening of the aisle, without any electrical controls. A ratcheting device, such as a pawl and a toothed wheel, is shiftable between a ratcheting state permitting movement of the movable storage unit only away from the facing storage unit or wall, and a non-ratcheting state permitting movement of the unit in either direction. The mechanism includes a bar biased toward the facing storage unit or wall, and a drive shaft rotated by the bar and driving a cam block to shift the pawl from its non-ratcheting state to its ratcheting state due to the movable storage unit having moved away from the facing storage unit or wall by a predetermined distance. The drive shaft is connected to the cam block by a lost motion connection, so that once the pawl is switched to its ratcheting state the cam block is no longer driven by the drive shaft. A reset switch is also provided for resetting the pawl to the non-ratcheting state, again permitting movement of the mobile storage unit toward the facing storage unit or wall. The reset switch works by rotating the cam block in the opposite direction once the cam block is freed from the drive shaft.

21 Claims, 4 Drawing Sheets

MECHANICAL AUTOMATIC AISLE LOCK

BACKGROUND OF THE INVENTION

This invention relates to mobile storage units, particularly those units moved by hand, and most particularly to those mobile storage units that have some type of locking means to prevent or at least reduce the incidence of accidental closure of an aisle.

It is well known to equip mobile filing and storage systems with locking mechanisms. The disadvantage of early locking mechanisms, though, was that they were required to be set to the locked mode only when the storage unit is at the desired location along the track. One example of structure such as this is Peterman, U.S. Pat. No. 4,523,794, which shows a locking mechanism used in conjunction with a handwheel by which the storage unit is moved along tracks on the floor. While the locking mechanism there disclosed operates very well, because of the details of the structure it is limited to use with the handwheel, besides the other disadvantages mentioned above. Another disadvantage of this type of locking mechanism is that it locks the storage unit against movement in both directions. Once the mechanism is engaged, it is not possible to move the storage unit in either direction. The necessity of always unlocking the storage unit before moving it and then re-locking it at the new location may be inconvenient and undesirable, particularly if only small increments of motion are required.

Another locking mechanism is shown in Peterman, U.S. Pat. No. 4,607,896. This mechanism includes a toothed rack positioned along the track on which the mobile storage unit moves. Again this arrangement is very effective in conjunction with the structure disclosed there, because it does not require a handwheel as indicated with respect to the earlier invention, and because even when engaged to prevent movement in one direction it permits movement in the other. But it is disclosed to be engaged by action of a lock and key. In certain instances it may be more convenient to have a lock mechanism that engages automatically, without any need for direct intervention or intentional action by a user.

This invention relates to improvements to the locking mechanisms described above, and to solutions to some of the problems raised or not solved thereby.

SUMMARY OF THE INVENTION

The present invention provides a locking mechanism for a mobile storage system having at least one movable storage unit for storing material and movable along a path. It is assumed that either a facing wall, a stationary storage unit, or another movable storage unit, is positioned on the path. The movable storage unit includes wheels for supporting the unit for easy movement along the path, and drive means for driving the wheels both toward the facing storage unit or wall and away therefrom. An aisle can thus be opened and closed between the facing storage unit or wall and the movable storage unit by movement of the movable unit. The locking mechanism provided by the invention automatically locks a movable storage unit from movement in one direction, while permitting movement in the opposite direction. The purpose of the locking mechanism is to prevent accidental closing of the aisle formed by the movement of the storage unit.

The invention provides for ratcheting means shiftable between a ratcheting state for permitting movement of the movable storage unit away from the facing storage unit or wall but preventing movement toward the facing storage unit or wall, and a non-ratcheting state permitting movement of the unit toward the facing storage unit or wall. Shifting means are provided for shifting, due to the movable storage unit having moved away from the facing storage unit or wall a predetermined distance, the ratcheting means from the non-ratcheting state to the ratcheting state. Means are also provided for resetting the ratcheting means to the non-ratcheting state, so that the ratcheting means permits movement of the mobile storage unit toward the facing storage unit or wall. The shifting means includes a bar biased toward the facing storage unit or wall, and means on the mobile storage unit for co-acting with the bar to shift the ratcheting means from its non-ratcheting state to its ratcheting state due to the movable storage unit having moved away from the facing storage unit or wall by the predetermined distance referred to above, that is, when the bar loses contact with the facing storage unit or wall. The ratcheting means includes a toothed wheel mounted to the movable storage unit and associated with the drive means for rotation therewith. A pawl is shiftable between an engaged position engaging the toothed wheel and preventing rotation in the direction corresponding to movement of the unit closing the aisle, and a non-engaged position not engaged with the toothed wheel and permitting rotation of the toothed wheel in either direction.

Other objects and advantages of the invention will become apparent hereinafter.

DESCRIPTION OF THE PREFERRED EMBODIMENTS

Figure 1:
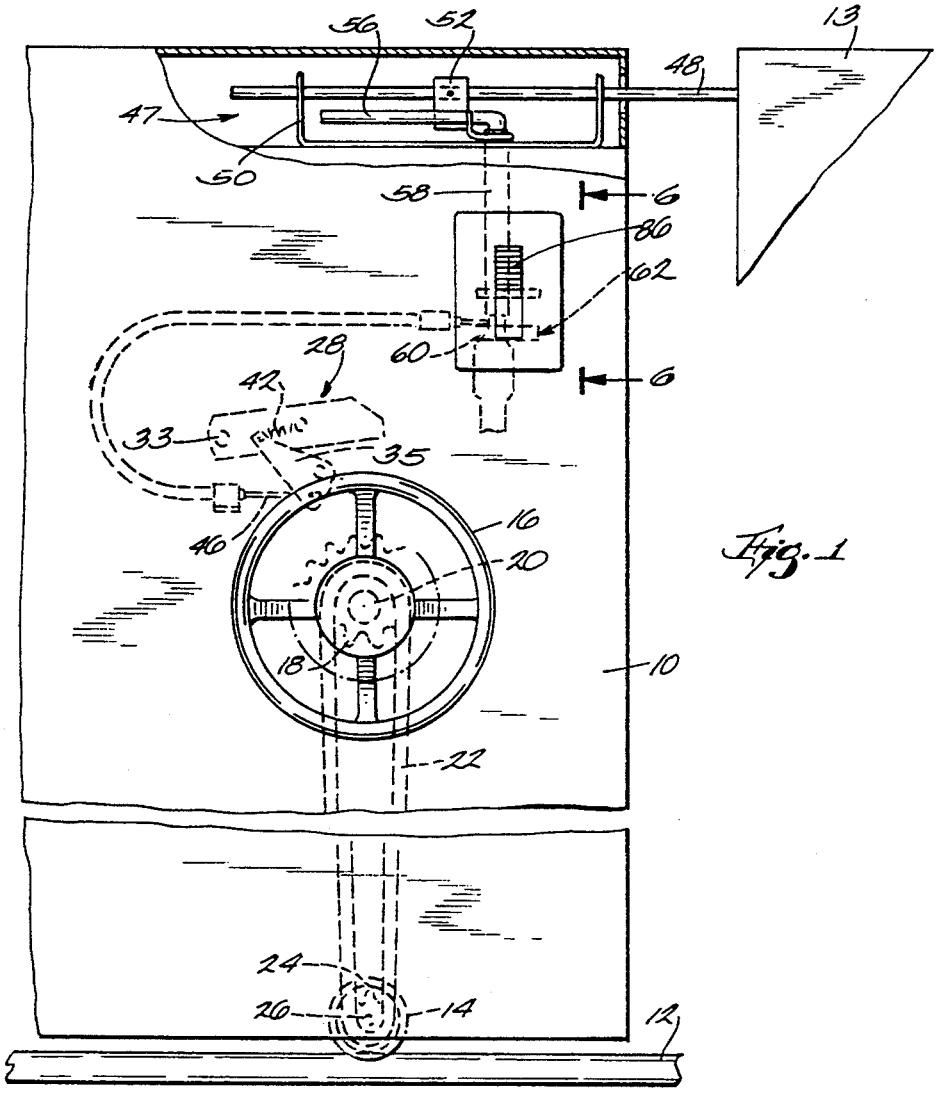
FIG. 1 is a front elevational view, partially cut away, of a movable storage unit constructed according to a preferred embodiment of the invention.

Referring now to FIG. 1, there is shown a movable storage unit 10 which may be a part of a mobile storage system. The movable storage unit 10 is movable along a path defined by a track 12, such as by means of a number of wheels 14. The unit 10 can be moved along the track 12 by any suitable source of motion, including pushing by hand or by some externally powered means such as an electric motor. A blocking object 13, such as a facing wall, an opposing stationary storage unit, or another movable storage unit, is positioned on the path. An aisle can thus be opened and closed between the blocking object 13 and the movable storage unit 10 by the movement of the unit away from the object, for instance so that the shelves of the mobile storage unit 10 can be accessed. The invention is particularly well suited to a unit that is powered by a handwheel 16 or corresponding hand lever system connected for rotation with an upper sprocket 18 by an upper shaft 20, as the handwheel will be used where use of electrical energy as a power source is undesirable or unavailable, and the invention requires no electrical energy. In this unit 10, power is transmitted between the upper sprocket 18 and the wheels 14 by a chain 22 reeved about the upper sprocket and a lower sprocket 24, which is in turn connected to the wheels by a lower shaft 26. Hence this invention may also be applied to a movable storage unit that is moved merely by manually pulling laterally on a handle on the unit.

According to the invention, ratcheting means 28 are provided, shiftable between a ratcheting state for permitting movement of the movable storage unit 10 away from the blocking object 13 to open the aisle, but preventing movement toward the blocking object to close the aisle and a non-ratcheting state permitting movement of the unit in either direction. In the embodiment shown in FIGS. 3, 4 and 5, the ratcheting means 28 includes a sprocket or toothed wheel 30 mounted to the movable storage unit 10 and associated with wheels 14 for rotation therewith. In particular, the toothed wheel 30 is shown affixed to the same upper shaft 20 to which the upper sprocket 18 is attached. Thus when the wheels 14 are rotated, such as by rotating the handwheel 16 (FIG. 1), the toothed wheel 30 rotates in the same direction and at the same number of revolutions per minute as the upper sprocket 18.

The ratcheting means 28 also includes a pawl 32 rotatably attached at one end thereof to the movable storage unit 10, such as by a peg 33, with the other end free to rotate. The pivot axis of pawl 32 about peg 33 is positioned with respect to the toothed wheel so that, by an over-center biasing means 34, the pawl is capable of being shifted between a non-engaged position where the free end of the pawl is clear of the toothed wheel (FIG. 4) and an engaged position wherein the free end of the pawl is in contact with the toothed wheel (FIG. 5). Thus in the non-engaged position shown in FIG. 4 the toothed wheel 30 is free to rotate in either direction, while in the engaged position shown in FIG. 5 the wheel is capable of rotating clockwise with a ratcheting action, but will be stopped by pawl 32 from counterclockwise rotation.

Figure 3:
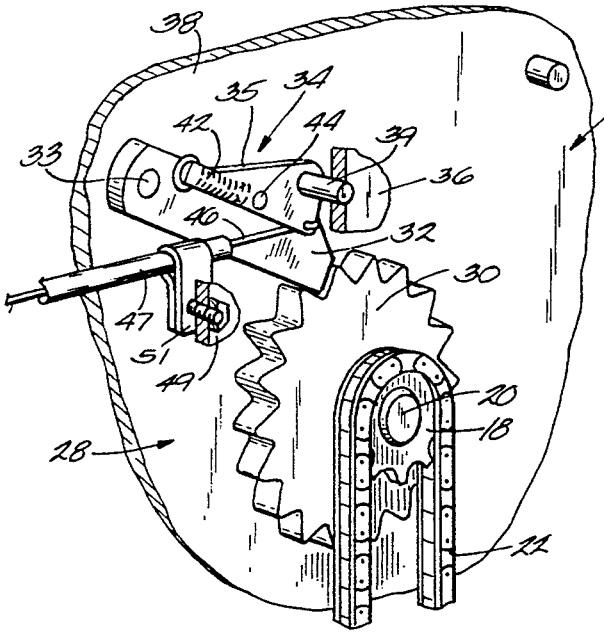
FIG. 3 is a perspective view, partially cut away, of a ratcheting mechanism constructed according to a preferred embodiment of the invention as shown in FIG. 1.
Figure 4:
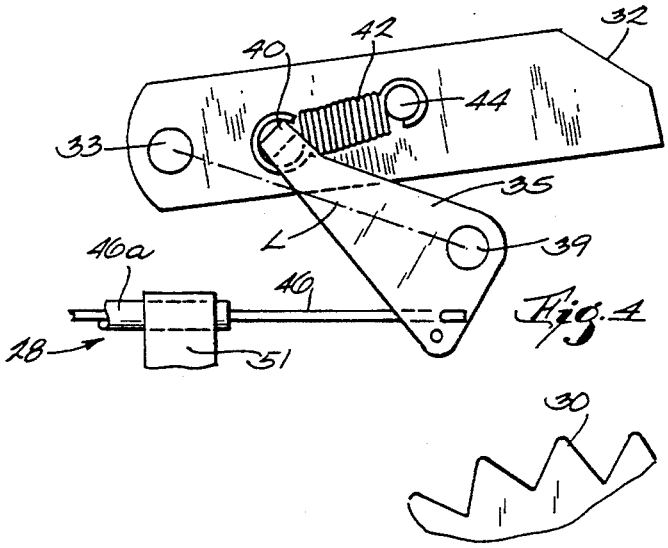
FIG. 4 is an elevational view, on an enlarged scale, of a preferred embodiment of the ratcheting mechanism shown in FIG. 1, in its non-engaged state.
Figure 5:
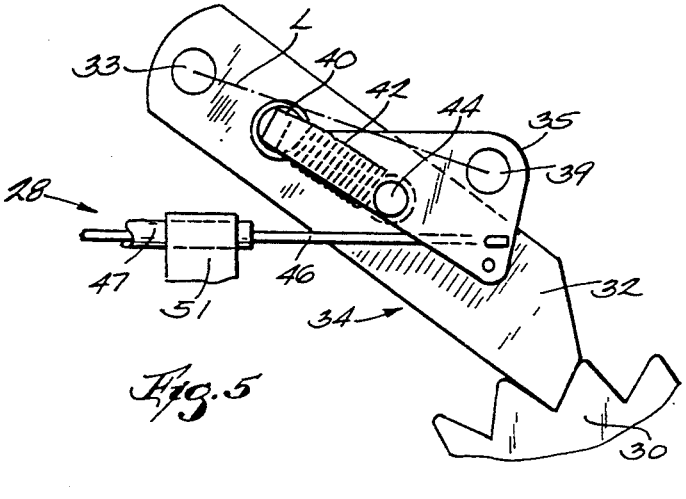
FIG. 5 is an elevational view, on an enlarged scale, of a preferred embodiment of the ratcheting mechanism shown in FIG. 1, in its engaged state.
Figure 8:
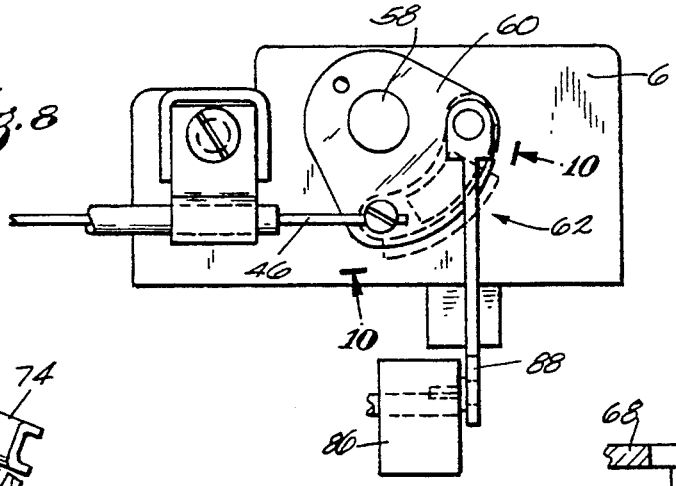
FIG. 8 is a top view of the switch/cam assembly shown in FIG. 6.
Figure 9:
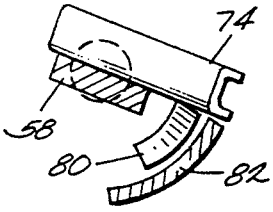
FIG. 9 is a cross sectional view of a portion of the switch cam assembly shown in FIG. 7, taken along line 9—9 thereof.
Figure 10:
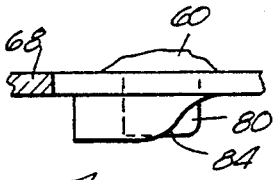
FIG. 10 is a cross sectional view of a portion of the switch cam assembly shown in FIG. 8, taken along line 10—10 thereof.
Figure 7:
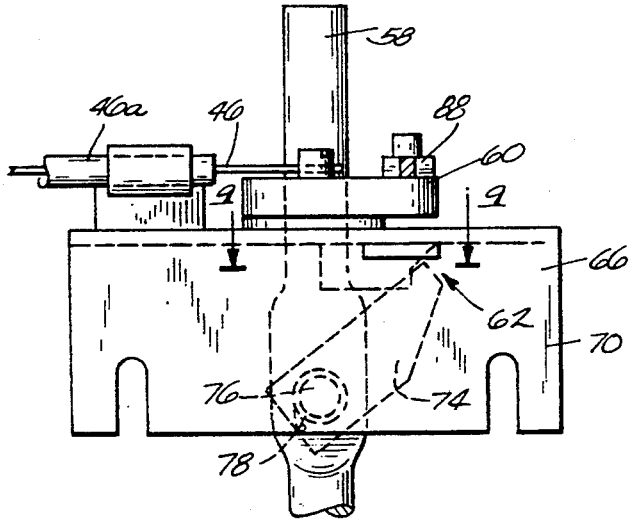
FIG. 7 is a front view of a portion of the switch/cam assembly shown in FIG. 6.
Figure 6:
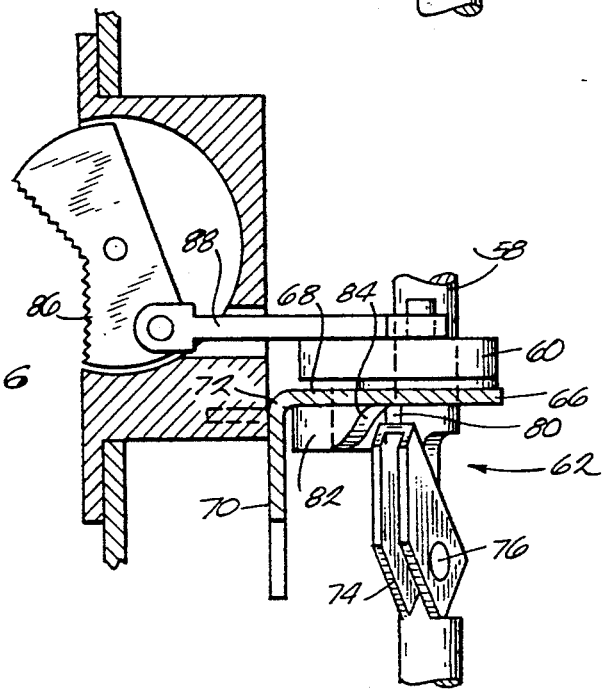
FIG. 6 is a side elevational view, partially cut away, on an enlarged scale, of a switch/cam assembly constructed according to a preferred embodiment of the invention, as shown in FIG. 1.

As shown in FIGS. 3 through 5, in this embodiment the biasing means 34 includes a spring-throw bracket 35 also rotatably attached to the unit 10, in particular to a surface 36 opposite the surface 38 to which the pawl 32 is attached, such as by a peg 39, so that bracket 35 is offset from pawl 32, permitting the bracket and the pawl to rotate past each other. That is, pawl 32 and bracket 35 are rotatable in substantially parallel planes, and the axis of rotation of pawl 32 is spaced apart from the axis of rotation of bracket 35. That is, peg 33 is spaced apart from peg 39, and the two pegs are mounted in facing surfaces. Bracket 35 has a spring connector portion 40 at a point spaced apart from its axis of rotation. An extension spring 42 is connected between spring connector 40 and a screw 44 provided for that purpose on pawl 32.

Means are provided for rotating the bracket 35 either upward in the drawing figures to disengage the pawl 32 from the toothed wheel 28 or downward to engage the pawl to the wheel. Thus, as the spring connector bracket portion 40 of the spring throw bracket 35 crosses the line L between peg 39 and peg 33, the spring 42 causes the pawl to swing abruptly to the same side of the line. This effect will be seen in either direction of movement of the bracket 35, upward or downward.

As shown in FIGS. 3 through 5, the means for rotating bracket 35 include a push-pull cable 46, which connects to the bracket at a point spaced apart from and non-collinear with the connector bracket portion 40 and peg 39, thus forming a triangular shape with the connector and the peg. Preferably cable 46 is provided with a sheath 46*a*, anchored by a clamp 51 to a portion 49 of the same surface 36 to which peg 39 is affixed. The effect of pulling the cable 46 will then be to rotate the bracket connector 40 upward, from the position shown in FIG. 5 to that shown in FIG. 4, while pushing the cable will cause the connector 40 to rotate downward, from the position shown in FIG. 4 to that shown in FIG. 5.

The position of the pawl 32 shown in FIG. 4 is the position in which it will be when the storage unit 10 is adjacent the blocking object 13, while the position shown in FIG. 5 will be the position assumed by the pawl just after the unit has moved away from the blocking object by a predetermined distance. Referring again to FIGS. 1 and 2, a drive shaft 58 is provided for the purpose of moving or shifting the pawl 32, from one position to the other, based on the distance of the storage unit 10 from the blocking object 13. Drive shaft 58 is rotatably mounted to the storage unit 10 and rotated by an aisle sensor means 47, as the unit moves away from the blocking object 13. Drive shaft 58 is connected to a cam block 60 by connecting means 62, in a manner to be explained in more detail hereinafter. As the aisle is opened and the movable storage unit 10 is moved away from the blocking object 13, the drive shaft 58 will be rotated clockwise by the aisle sensor means. This movement rotates cam block 60 clockwise. Cable 46, one end of which was described above to be attached to spring throw bracket 35, has its other end attached to cam block 60 at a point separated from the axis of rotation of the cam block, such that this clockwise rotation of the cam block causes the cable to be pushed, shifting the pawl 32 from its disengaged position to its engaged position as described above. The physical positioning of the two ends of cable 46 relative to each other may be other than as shown in FIG. 1, and forms no part of the invention.

Figure 2:
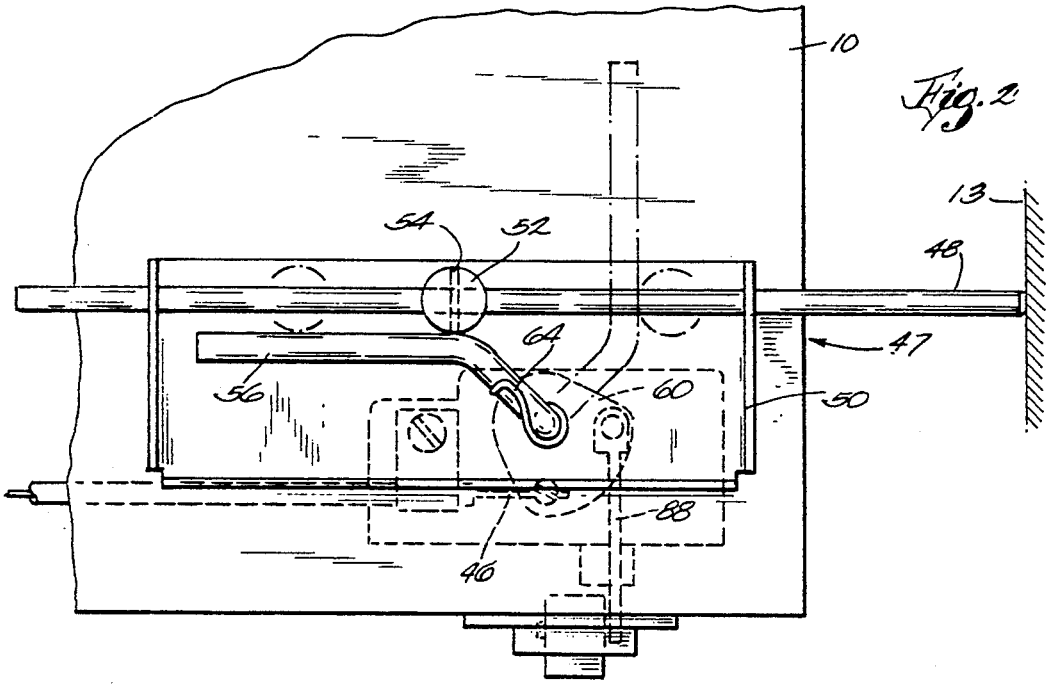
FIG. 2 is a top plan view of the movable storage unit shown in FIG. 1.

One embodiment of aisle sensor means 47 is shown in FIGS. 1 and 2. This embodiment of aisle sensor means 47 includes an aisle sensor bar 48 slidably mounted within a widened squared U-shaped bracket 50, in turn attached to the movable storage unit 10, preferably at the top thereof above normal walking height, so as to avoid interference with users accessing the unit 10. The bar 48 is of sufficient length and is positioned so as to extend beyond the side of the unit 10 toward the blocking object 13, while still maintaining both ends of the bar in the bracket 50. An aisle sensor block 52 is affixed, such as by a set screw 54, to the bar 48, within the bracket 50, and slides with the bar. This sensor block 52 protrudes beyond the bar 48, either above or below. A lever 56 is rotatably mounted through the top bracket 50 and projects in a horizontal plane substantially parallel to the horizontal plane containing the bar 48. A lower portion of the lever 56 extends downward and acts as drive shaft 58, connected to cam block 60 as indicated above. Drive shaft 58 need not be integrally formed with the lever 56, but may be a separate part affixed thereto.

Lever 56 is biased by a biasing means, such as a torsion spring 64 affixed thereto at the pivot axis thereof, toward a position transverse to the bar 48, that position shown in phantom in FIG. 2. When the bar 48 is in contact with the blocking object 13 and the aisle is fully closed, the lever 56 will be rotated toward a position generally parallel to the bar, that position shown in solid lines in FIG. 2. Thus the aisle sensor means 47, through the drive shaft 58 and cam block 60, pulls the cable 46 and switches the pawl 32 to its engaged position as shown in FIG. 5.

Figure 11:
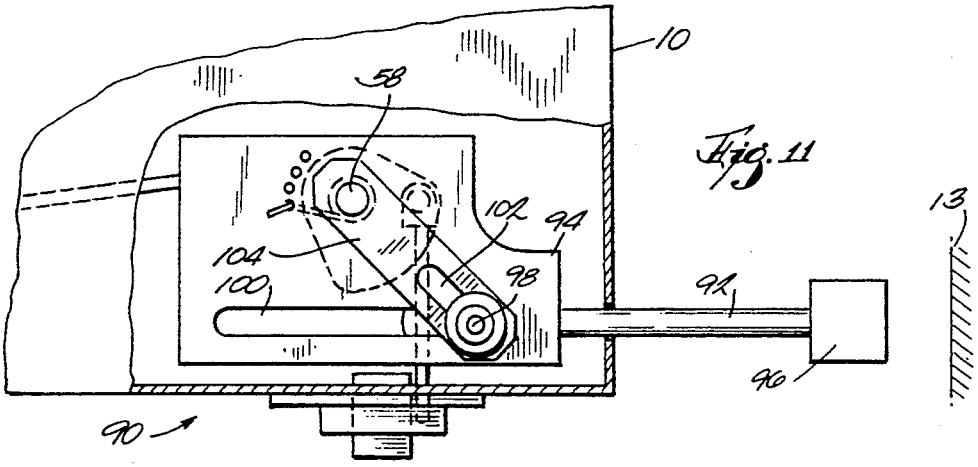
FIG. 11 is a top plan view of a movable storage unit having an aisle sensor means constructed according to an alternative embodiment of the invention.
Figure 12:
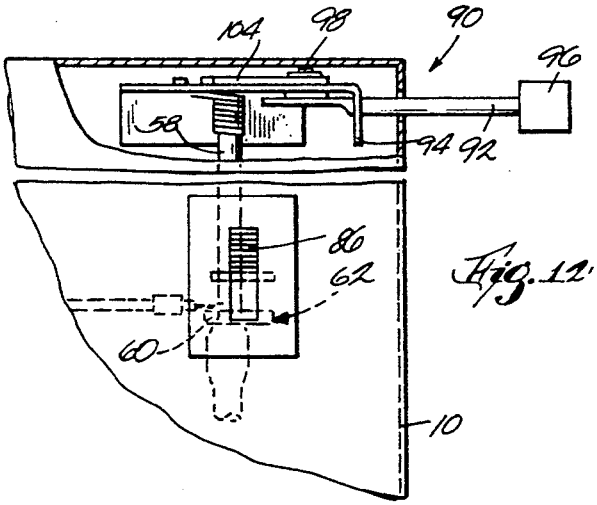
FIG. 12 is a side elevational view, partially cut away, of the embodiment shown in FIG. 11.

An alternative embodiment of an aisle sensor means is shown in FIGS. 11 and 12, as aisle sensor 90. This aisle sensor means 90, the best mode of carrying out the aisle sensor means in general within the present knowledge of the inventors, includes an aisle sensor bar 92, generally shorter than aisle sensor bar 48 of FIGS. 1 and 2. Sensor bar 92 is slidably mounted to a bracket 94, in turn attached to the movable storage unit 10, preferably again at the top thereof. The bar 92 is of sufficient length and is positioned so that one end thereof extends beyond the side of the unit 10 toward the blocking object 13. A bumper 96 of softer material than the bar 92 may be affixed to the extending end of the bar, so as to reduce any marring or other damage associated with the bar contacting the blocking object 13. The sensor bar 92 has a pin 98 affixed thereto, at a position spaced apart from bumper 96. Pin 98 passes through a guide slot 100 positioned, in bracket 94 as shown in FIGS. 11 and 12, to permit axial sliding of the bar with respect to the unit 10. The pin 98 also passes through a slot 102 in a link 104, which link is affixed to the drive shaft 58.

In this embodiment, drive shaft 58 is biased by the biasing means directly, toward a position where the bar 92 extends as far out of the unit 10 as possible, with bumper 96 being as close to the blocking object 13 as possible, as shown in FIGS. 11 and 12. As with the embodiment shown in FIGS. 1 and 2, any suitable biasing means, such as torsion spring 64 affixed to drive shaft 58, may be employed. When the bumper 96 is in contact with the blocking object 13 and the aisle is fully closed, the pin 98 will be at the opposite end of guide slot 100 as that shown in FIG. 11, the drive shaft 58 then being rotated clockwise from that shown in FIG. 11. Thus the aisle sensor means 90, through the drive shaft 58 and cam block 60, pulls the cable 46 and switches the pawl 32 to its engaged position as shown in FIG. 5 in substantially the same manner as the aisle sensor means 47 of FIGS. 1 and 2.

Figure 13:
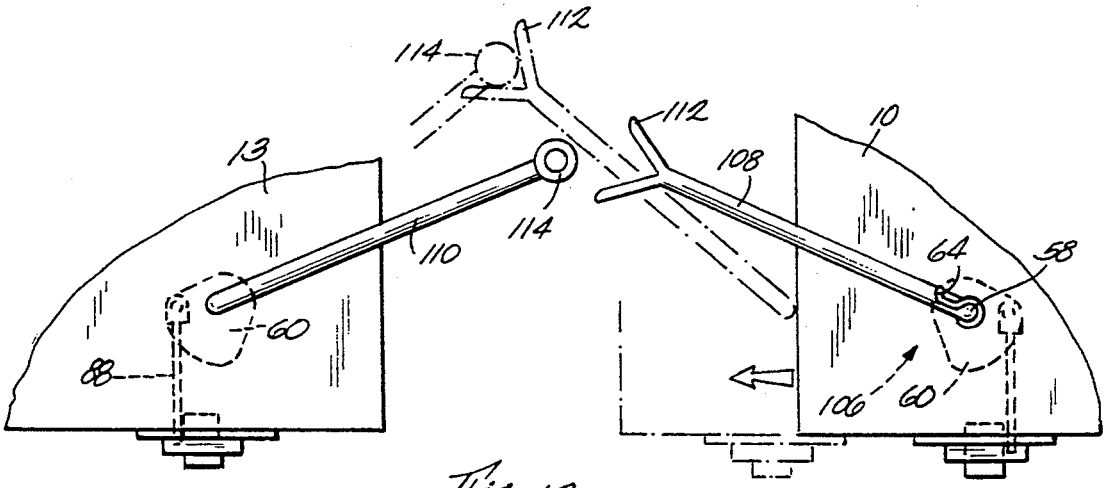
FIG. 13 is a top plan view of a movable storage unit having an aisle sensor means constructed according to another alternative embodiment of the invention.

Yet another embodiment of an aisle sensor means is shown in FIG. 13, as aisle sensor 106. This aisle sensor means 106 includes an aisle sensor lever 108 joined to or formed integrally with the drive shaft 58 and projecting horizontally outward beyond the edge of the storage unit 10, at an oblique angle to the edge. Aisle sensor 106 also includes a similar sensor lever 110 rotatably affixed to the blocking object 13. Sensor lever 108 terminates in a rotatable engaging means, or mating end 112, and sensor lever 110 terminates with a complementary rotatable engaging means, or mating end 114, positioned and affixed so that the two mating ends are capable of mutual rotating engagement, thus causing rotation of both levers when the unit 10 approaches the blocking object 13. For instance, as shown in FIG. 13, end 112 may be a fork while end 114 is a cylinder.

Sensor lever 108 is biased by torsion spring 64 affixed thereto at the pivot axis thereof, toward the position shown in FIG. 13. As the space between storage unit 10 and blocking object 13 is reduced, and the aisle between them closes, mating ends 112 and 114 engage each other. As shown in phantom, further movement of unit 10 and object 13 together forces the levers 108 and 110 to rotate, lever 108 clockwise and lever 110 counterclockwise. Thus, again, the aisle sensor means 106, through the drive shaft 58 and cam block 60, pulls the cable 46 and switches the pawl 32 to its engaged position as shown in FIG. 5. If the blocking object 13 is another movable storage unit, lever 110 may also be connected to a drive shaft 58 in that unit, to accomplish the same purpose for that unit.

As indicated above, connecting means 62 for connecting drive shaft 58 and cam block 60 is not a rigid connection, but rather a lost motion connection. The purpose of connecting means 62 being a lost motion connection is to provide means for resetting the pawl 32 to its non-engaged position without the aisle sensor 47 sensing or contacting the blocking object 13, as once the pawl has been moved to its engaged position shown in FIG. 5, it will prevent any motion of the unit 10 toward the blocking object. Details of the lost motion connection provided by connecting means 62 can be seen by reference to FIGS. 6 through 10.

Referring now to those figures, cam block 60 rotates in an opening provided for that purpose in a support bracket 66, mounted directly or indirectly to the movable storage unit 10. As can be seen by comparing FIGS. 6, 7 and 8, bracket 66 includes a substantially horizontal "shelf" portion 68, joined to a substantially vertical attachment portion 70 by a bight area 72. Cam block 60 then rotates in an opening in the shelf portion 68. As indicated above, the cam block 60 is rotated by the rotation of the drive shaft 58. This rotation is accomplished by use of a lug 74 rotatably attached to drive shaft 58 at a position just beneath cam block 60. Lug 74 is rotatable about a generally horizontal pin 76 through drive shaft 58, and biased upward by a biasing means such as torsion spring 78. Cam block 60 has a cam lobe 80 (FIGS. 9 and 10) projecting downward therefrom, and through an arcuate opening in the bracket shelf 68. The bracket shelf 68 also has a downwardly projecting ramp lobe 82, arcuately formed and positioned just outboard of the arcuate opening. Ramp lobe 82 has at least a ramped portion 84 sloping from the bracket shelf 68 downward. As can be seen by comparing FIGS. 6, 9 and 10, cam lobe 80 and ramp lobe 82 are substantially co-extensive, or at least the cam lobe can be no longer than the ramp lobe.

The rotation of cam block 60 by drive shaft 58 is accomplished by the lug 74 being in contact with the side of the cam lobe 80, causing the cam block to rotate with the drive shaft. As the drive shaft 58 continues to rotate, the lug 74 encounters the ramped portion 84 of the ramp lobe 82. With continued rotation of the drive shaft 58 beyond that point, ramp lobe 82 forces the lug 74 to pivot downward, until the lug is taken entirely out of contact with the cam lobe 80. At that point cam block 60 is no longer rotated by drive shaft 58, and the drive shaft may continue to rotate, without further rotating the cam block. Also at that point, cam block 60 has rotated sufficiently, pushing cable 46, so as to cause pawl 32 to switch to its downward position (FIG. 5), engaging the toothed wheel 30 and permitting ratcheting motion thereof as the storage unit 10 continues to move away from the blocking object 13 while preventing motion of the storage unit toward the blocking object.

In order to reset the pawl 32 to its disengaged position as shown in FIG. 4, in this embodiment a switch, such as rocker switch 86, is rotatably attached to the unit 10. One side of switch 86 is connected to the cam block 60 by a connecting rod 88, in such a manner that pushing that side of the rocker switch pulls the connecting rod, rotating the cam block counterclockwise, thus pulling cable 46 and switching pawl 32 from its engaged position to the disengaged position shown in FIG. 4. The toothed wheel 30 is then free to rotate in either direction, and the unit 10 may then be moved back toward the blocking object 13.

When the unit 10 approaches the blocking object 13, the aisle sensor 47 senses the proximity of the object, bar 48 again making contact therewith. Drive shaft 58 is thus rotated counterclockwise, bringing the lug 74 back to again be latched behind the cam lobe 80. The lever 56 is thus permitted to rotate back to the position shown in solid lines in FIG. 2.

Thus the invention provides a means for automatically preventing the accidental closure of an aisle, which is easily resettable, all without any need whatsoever for electrical power. While the apparatus hereinbefore described is effectively adapted to fulfill the aforesaid objects, it is to be understood that the invention is not intended to be limited to the specific preferred embodiment of mechanical automatic aisle lock set forth above. Rather, it is to be taken as including all reasonable equivalents within the scope of the following claims.

We claim:

1. In combination with a mobile storage system having at least one movable storage unit for storing material and adapted to be movable along a path, at least one blocking object on said path, and wheels supporting the movable storage unit for easy movement along the path both toward said blocking object and away therefrom;

ratcheting means shiftable between a ratcheting state for permitting movement of the movable storage unit away from the blocking object but preventing movement toward the blocking object and a non-ratcheting state permitting movement of said movable storage unit in either direction;

shifting means for shifting said ratcheting means from said non-ratcheting state to said ratcheting state; and a mechanical sensor for mechanically sensing distance between said movable storage unit and said blocking object, and for mechanically activating said shifting means when the distance being sensed reaches a predetermined minimum amount of distance;

said shifting means including a drive shaft rotatable by said aisle sensor when said movable storage unit is moving in proximity to said blocking object, and a cam block rotatable by said drive shaft and connected to said ratcheting means to shift said ratcheting means between said non-ratcheting state and said ratcheting state, wherein said drive shaft and said cam block are connected together by a lost motion connection, such that movement of said movable storage unit away from said blocking object causes said drive shaft to cause said cam block to rotate, but movement of said movable storage unit toward said blocking object does not cause said drive shaft to cause said cam block to rotate.

2. The combination as recited in claim 1 further comprising means for resetting said ratcheting means to said non-ratcheting state, so that said ratcheting means permits movement of said movable storage unit toward said blocking object.

3. The combination as recited in claim 1 wherein said shifting means includes a bar on said movable storage unit, and means for co-acting with said bar to shift said ratcheting means from said non-ratcheting state to said ratcheting state by movement of said movable storage unit away from said blocking object to at least said predetermined minimum amount of distance.

4. The combination as recited in claim 1 wherein said ratcheting means includes:

a toothed wheel mounted to said movable storage unit and associated with said wheels of said movable storage unit for rotation therewith;

a pawl, shiftable between an engaged position engaging said toothed wheel and preventing rotation in the direction corresponding to movement of said movable storage unit toward said blocking object, and a non-engaged position not engaged with said toothed wheel and permitting rotation of said toothed wheel in either direction.

5. In combination with a mobile storage system having at least one movable storage unit for storing material and adapted to move along a path, at least one blocking object on said path, wheels supporting the movable storage unit for easy movement along the path, and drive means for driving the wheels both toward the blocking object and away therefrom;

an apparatus for automatically preventing movement of the movable storage unit toward the blocking object once said movable storage unit has moved more than a predetermined distance from the blocking object, said apparatus comprising:

a toothed wheel mounted to said movable storage unit and associated with said wheels of said movable storage unit for rotation therewith;

a pawl, shiftable between an engaged position engaging said toothed wheel and preventing rotation in the direction corresponding to movement of said movable storage unit toward said blocking object, and a non-engaged position not engaged with said toothed wheel and permitting rotation of said toothed wheel in either direction;

shifting means for shifting said pawl to said engaged position when said movable storage unit has moved away from said blocking object said predetermined distance; and a mechanical sensor for mechanically sensing distance between said movable storage unit and said blocking object, and for mechanically activating said shifting means when the distance being sensed reaches said predetermined distance;

said shifting means including a drive shaft rotatable by said aisle sensor when said movable storage unit is moving in proximity to said blocking object, and a cam block rotatable by said drive shaft and connected to said ratcheting means to shift said ratcheting means between said non-ratcheting state and said ratcheting state, wherein said drive shaft and said cam block are connected together by a lost motion connection, such that movement of said movable storage unit away from said blocking object causes said drive shaft to cause said cam block to rotate, but movement of said movable storage unit toward said blocking object does not cause said drive shaft to cause said cam block to rotate.

6. The combination as recited in claim 5 further comprising means for resetting said pawl to said non-engaged position, so that said toothed wheel is permitted to rotate in a direction corresponding to movement of said movable storage unit toward said blocking object.

7. The combination as recited in claim 5 wherein said shifting means includes a slidable bar, and means for co-acting with said bar to shift said pawl from said non-engaged position to said engaged position due to said movable storage unit having moved away from said blocking object said predetermined distance.

8. The combination as recited in claim 5 wherein said shifting means includes a bar slidably mounted to said movable storage unit and biased toward said blocking object, and means for co-acting with said bar to shift said pawl from said non-engaged position to said engaged position due to said movable storage unit having moved far enough away from said blocking object that said bar loses contact with said blocking object.

9. An aisle locking device for application to a mobile storage system having at least one movable storage unit for storing material and adapted to be movable along a path, at least one blocking object on said path, and wheels for supporting the movable storage unit for easy movement along the path both toward said blocking object and away therefrom, said locking device comprising:

ratcheting means shiftable between a ratcheting state for permitting movement of a movable storage unit away from a blocking object but preventing movement toward the blocking object and a non-ratcheting state permitting movement of said movable storage unit in either direction;

shifting means for shifting said ratcheting means from said non-ratcheting state to said ratcheting state; and a mechanical sensor for mechanically sensing distance between said movable storage unit and said blocking object, and for mechanically activating said shifting means when the distance being sensed reaches a predetermined minimum amount of distance;

said shifting means including a drive shaft rotatable by said aisle sensor when said movable storage unit is moving in proximity to said blocking object, and a cam block rotatable by said drive shaft and connected to said ratcheting means to shift said ratcheting means between said non-ratcheting state and said ratcheting state, wherein said drive shaft and said cam block are connected together by a lost motion connection, such that movement of said movable storage unit away from said blocking object causes said drive shaft to cause said cam block to rotate, but movement of said movable storage unit toward said blocking object does not cause said drive shaft to cause said cam block to rotate.

10. An aisle locking device as recited in claim 9 further comprising means for resetting said ratcheting means to said non-ratcheting state, so that said ratcheting means permits movement of said movable storage unit toward said blocking object.

11. An aisle locking device as recited in claim 9 wherein said shifting means includes a bar on said movable storage unit, and means for co-acting with said bar to shift said ratcheting means from said non-ratcheting state to said ratcheting state due to said movable storage unit having moved away from said blocking object said predetermined minimum amount of distance.

12. An aisle locking device as recited in claim 9 wherein said ratcheting means includes:

a toothed wheel mounted to said movable storage unit and associated with said wheels of said movable storage unit for rotation therewith;

a pawl, shiftable between an engaged position engaging said toothed wheel and preventing rotation in the direction corresponding to movement of said movable storage unit toward said blocking object, and a non-engaged position not engaged with said toothed wheel and permitting rotation of said toothed wheel in either direction.

13. An aisle locking device for application to a mobile storage system having at least one movable storage unit for storing material and adapted to be movable along a path, at least one blocking object on said path, and wheels for supporting the movable storage unit for easy movement along the path both toward said blocking object and away therefrom, said locking device comprising:

ratcheting means shiftable between a ratcheting state for permitting movement of a movable storage unit away from a blocking object but preventing movement toward the blocking object and a non-ratcheting state permitting movement of said movable storage unit in either direction;

an aisle sensor mounted to said movable storage unit;

a drive shaft rotatable by said aisle sensor when said movable storage unit is moving in proximity to said blocking object; and a cam block rotatable by said drive shaft and connected to said ratcheting means to shift said ratcheting means between said non-ratcheting state and said ratcheting state;

wherein said drive shaft and said cam block are connected together by a lost motion connection, such that movement of said movable storage unit away from said blocking object causes said drive shaft to cause said cam block to rotate, but movement of said movable storage unit toward said blocking object does not cause said drive shaft to cause said cam block to rotate.

14. An aisle locking device as recited in claim 13 wherein said cam block is connected to said ratcheting means by means of a push-pull cable.

15. An aisle locking device as recited in claim 13 wherein said cam block is rotatably mounted to a bracket, and wherein said lost motion connection includes a ramp lobe on said bracket, a cam lobe on said cam block, and a lug connected to said drive shaft.

16. An aisle locking device as recited in claim 15 wherein said lug is rotatably connected to said drive shaft and biased toward said cam block, such that as said lug rotates with said drive shaft, it contacts said cam lobe and causes said cam block to rotate with said drive shaft until said lug encounters said ramp lobe, which ramp lobe with continued rotation of said drive shaft causes said lug to rotate away from said cam block and lose contact with said cam lobe.

17. An aisle locking device as recited in claim 13 wherein said aisle sensor includes a lever joined to said drive shaft such that actuation of said lever causes rotation of said drive shaft.

18. An aisle locking device as recited in claim 17 wherein said lever is actuated by a slider bar which extends beyond the movable storage unit and contacts the blocking object, and which bar is slidable linearly by the action of said storage unit moving toward and away from said blocking object.

19. An aisle locking device as recited in claim 18 further comprising an aisle sensor block affixed to said slider bar, and protruding beyond said slider bar, said sensor block contacting said lever to rotate said lever with the linear sliding motion of said slider bar.

20. An aisle locking device as recited in claim 18 wherein said lever comprises a slotted link affixed to said drive shaft, and further comprising a pin slidably affixed to said slotted link and rotatably affixed to said slider bar, so as to rotate said link with the linear sliding motion of said slider bar.

21. An aisle locking device as recited in claim 17 wherein said lever terminates in a rotatable engaging means, and wherein said blocking object includes a rotatable lever with a complementary rotatable engaging means, positioned and affixed so that said two engaging means engage together and cause rotation of both of said levers when said movable storage unit approaches said blocking object.

* * * * *